US006941718B1

(12) United States Patent
diGirolamo et al.

(10) Patent No.: US 6,941,718 B1
(45) Date of Patent: Sep. 13, 2005

(54) WALL STRUCTURE

(75) Inventors: Edward R. diGirolamo, Raleigh, NC (US); Michael L. Torres, Raleigh, NC (US); Robert W. Herrmann, Raleigh, NC (US); Aaron M. Herrmann, Raleigh, NC (US); Thomas C. Boyd, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 162 days.

(21) Appl. No.: 10/058,958

(22) Filed: Jan. 28, 2002

(51) Int. Cl.[7] ..... E04C 3/02

(52) U.S. Cl. ..... 52/695; 52/693; 52/696; 52/800.12; 52/656.9

(58) Field of Search ..... 52/693, 695, 653.1, 52/656.1, 696, 731.1, 731.5, 731.9, 800.12, 52/800.15, 800.17

(56) References Cited

U.S. PATENT DOCUMENTS 2,126,511 A * 8/1938 Soule
2,963,127 A * 12/1960 Manville ..... 52/693
4,235,054 A * 11/1980 Cable et al. ..... 52/210
5,315,803 A * 5/1994 Turner ..... 52/720
5,657,606 A * 8/1997 Ressel et al. ..... 52/690
5,729,950 A * 3/1998 Hardy ..... 52/693
6,148,583 A * 11/2000 Hardy ..... 52/693
6,185,898 B1 * 2/2001 Pratt ..... 52/657
6,389,778 B1 * 5/2002 Strange ..... 52/745.19
6,460,297 B1 * 10/2002 Bonds et al. ..... 52/79.1
6,505,442 B2 * 1/2003 Banicevic et al. ..... 49/501
6,694,695 B2 * 2/2004 Collins et al. ..... 52/568

* cited by examiner

*Primary Examiner*—Robert Canfield
*Assistant Examiner*—Yvonne M. Horton
(74) *Attorney, Agent, or Firm*—Coats & Bennett, P.L.L.C.

(57) ABSTRACT

A wall structure adapted to be fabricated in sections or modules and comprises an upper member, a lower member, a plurality of studs interconnected between the upper and lower members with respective studs including openings therein, and at least one diagonal brace member extending through the openings within the studs and interconnected between opposed corners of the wall structure. Because the internal brace extends generally centrally through the plane of the wall, the wall structure is designed to carry loads concentrically from the point of applied loads to a foundation or other termination point.

26 Claims, 7 Drawing Sheets

WALL STRUCTURE

FIELD OF THE INVENTION

The present invention relates to wall structures and more particularly to wall structures that may be fabricated in sections or modules.

BACKGROUND OF THE INVENTION

It is important in the design of wall structures to provide both lateral strength and lateral rigidity. Lateral strength is required to resist horizontal loads due to, for example, wind and earthquake forces. If the wall structure is properly designed and constructed, components of the wall will transfer these horizontal or shear forces to adjacent elements in the load path such as other wall components, floors or foundations.

Lateral rigidity is required to prevent the floors and roof from excessive side-sway. If the walls are sufficiently rigid, they will prevent floor and roof framing members from moving off their supports. In addition, buildings with sufficient lateral rigidity will suffer less non-structural damage and thereby avoid long-term degradation due to cracking and water infiltration.

It has long been common to brace walls or wall sections in buildings in order to provide some lateral strength and rigidity. Generally, this bracing has been provided through either sheathing secured to the outside of the wall or by straps or braces that extend at a diagonal along the outside of the wall. Such sheathing and diagonal bracing do transfer loads and tend to provide some measure of lateral strength and lateral rigidity in the wall. However, because of the location of the sheathing or the bracing, the loads transferred are transferred eccentrically. This, of course, results in the loads tending to twist the wall structure and its components, and consequently these loads are not directly and concentrically transferred to the foundation or other termination points. In the end, such exterior sheathing and exterior bracing does not efficiently transfer shear loads.

Therefore, there has been and continues to be a need for a wall structure or wall module that is designed to efficiently provide both lateral strength and lateral rigidity through a concentric design.

SUMMARY OF THE INVENTION

The present invention relates to a wall structure, wall component or wall module that includes a pair of opposed members and a plurality of spaced apart studs connected between the opposed members. Openings are formed in the respective studs and at least one diagonal brace extends through the openings of the studs and is effectively connected at opposite ends to oppose corner areas of the wall structure.

In one embodiment, the diagonal bracing or support extends generally centrally through the wall structure. That is, the wall structure includes a pair of opposed sides and a generally central area disposed between the two opposed sides. The bracing includes a diagonal member such as a metal rod, shaft or cable that extends through the general central area or through a central plane of the wall structure or wall module. This generally centrally disposed brace or support is operative to carry and transfer loads concentrically from the point of the applied loads to one or more termination points.

In one particular embodiment of the present invention, the wall structure or wall module includes an upper member, a lower member, and a series of spaced apart studs connected between the upper and lower members. Openings are provided in a series of the studs. A diagonal brace extends through the openings within the studs and wherein the openings within the studs are spaced such that the diagonal brace or diagonal support structure can extend between opposed corner areas of the wall structure or wall module. A pair of connectors are connected to opposite ends of the brace or support structure and extend therefrom to where the connectors connect to opposed corner areas of the wall structure.

In another particular embodiment of the present invention, the connectors just discussed are effectively connected at one end to the diagonal brace or support structure and at the other end the connector extends between one of the studs, or an end column, and either the upper or lower member of the wall structure. There the connector is fastened to the wall structure.

Other objects and advantages of the present invention will become apparent and obvious from a study of the following description and the accompanying drawings which are merely illustrative of such invention.

DESCRIPTION OF AN EXEMPLARY EMBODIMENT

Figure 1:
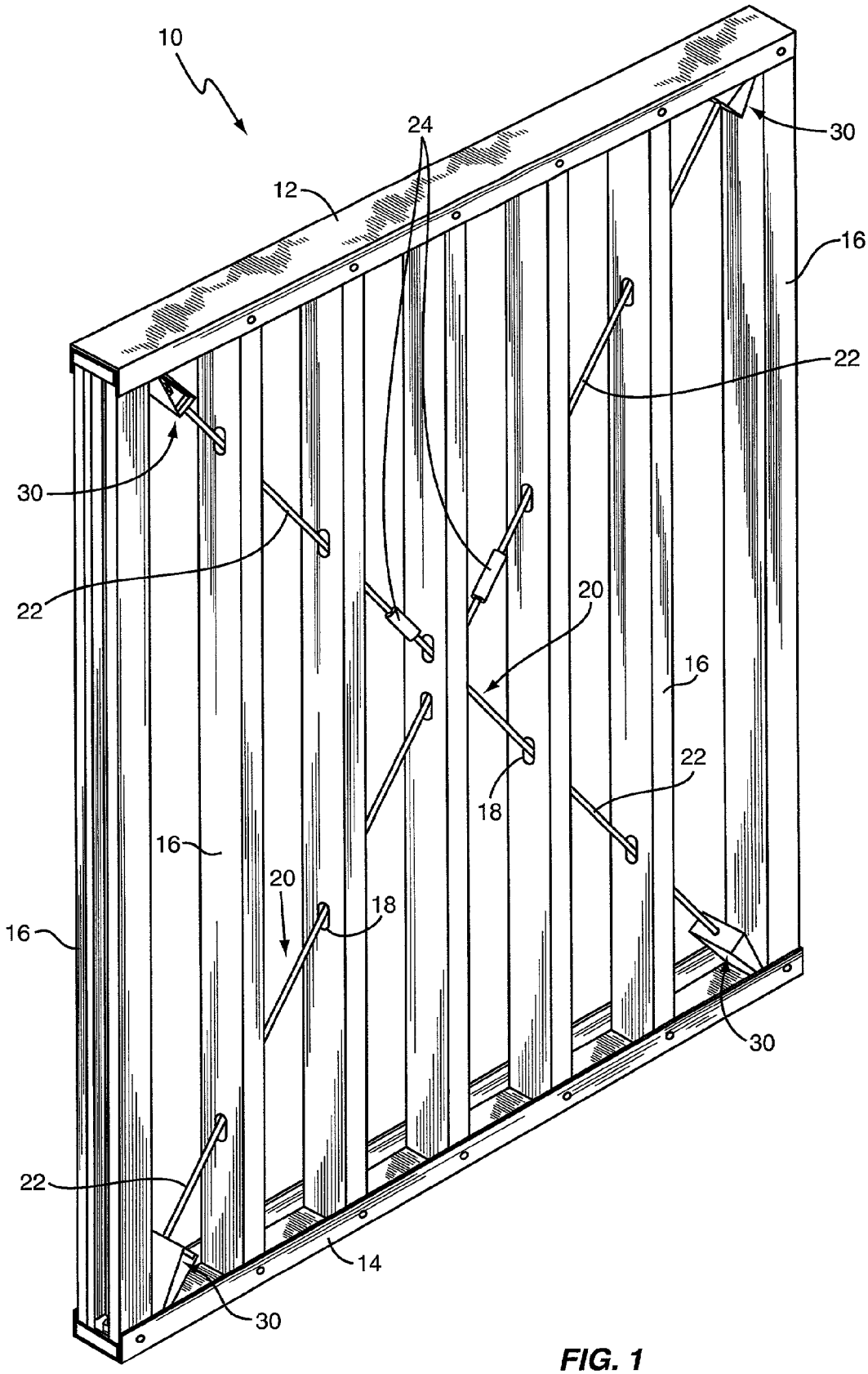
FIG. 1 is a perspective view of the wall structure or wall module of the present invention.

With further reference to the drawings, the wall structure or wall module of the present invention is shown therein and indicated generally by the numeral 10. Wall structure 10 basically comprises an upper member 12 and a lower member 14. Members 12 and 14 may assume various configurations but in one embodiment, upper member 12 and lower member 14 would be of a generally U-shaped channel construction. In the case of the U-shaped channel construction, each member 12 and 14 would include a central or web portion and a pair of upturned, or downturned, as the case may be, flanges.

Secured between the upper member 12 and lower member 14 is a plurality of spaced apart studs 16. The studs are secured to both the upper and lower members 12 and 14. Studs 16 may be secured to the upper and lower members 12 and 14 in any number of ways. For example, fasteners such as screws can be extended through the flanges of the upper and lower members 12 and 14 into the respective studs. In addition, or in the alternative, 90° clips can be used to connect the respective studs to members 12 and 14.

Each stud 16 in the embodiment illustrated is of a channel construction and includes a web and a pair of opposed flanges. Certain studs 16 provided within the wall structure 10 are provided with openings 18 formed in the web portion of the studs. As will be appreciated from subsequent portions of this disclosure, the openings 18 are particularly spaced. For the most part, each of the studs 16 found in the wall structure 10 are of the same basic construction. However, in certain embodiments, the studs positioned on opposite ends of the wall structure 10 may be referred as columns and may be of a slightly different configuration and/or a heavier gauge metal in the case of a metal wall structure. In fact, the ends or columns of the wall module may comprise multiple members.

Figure 2:
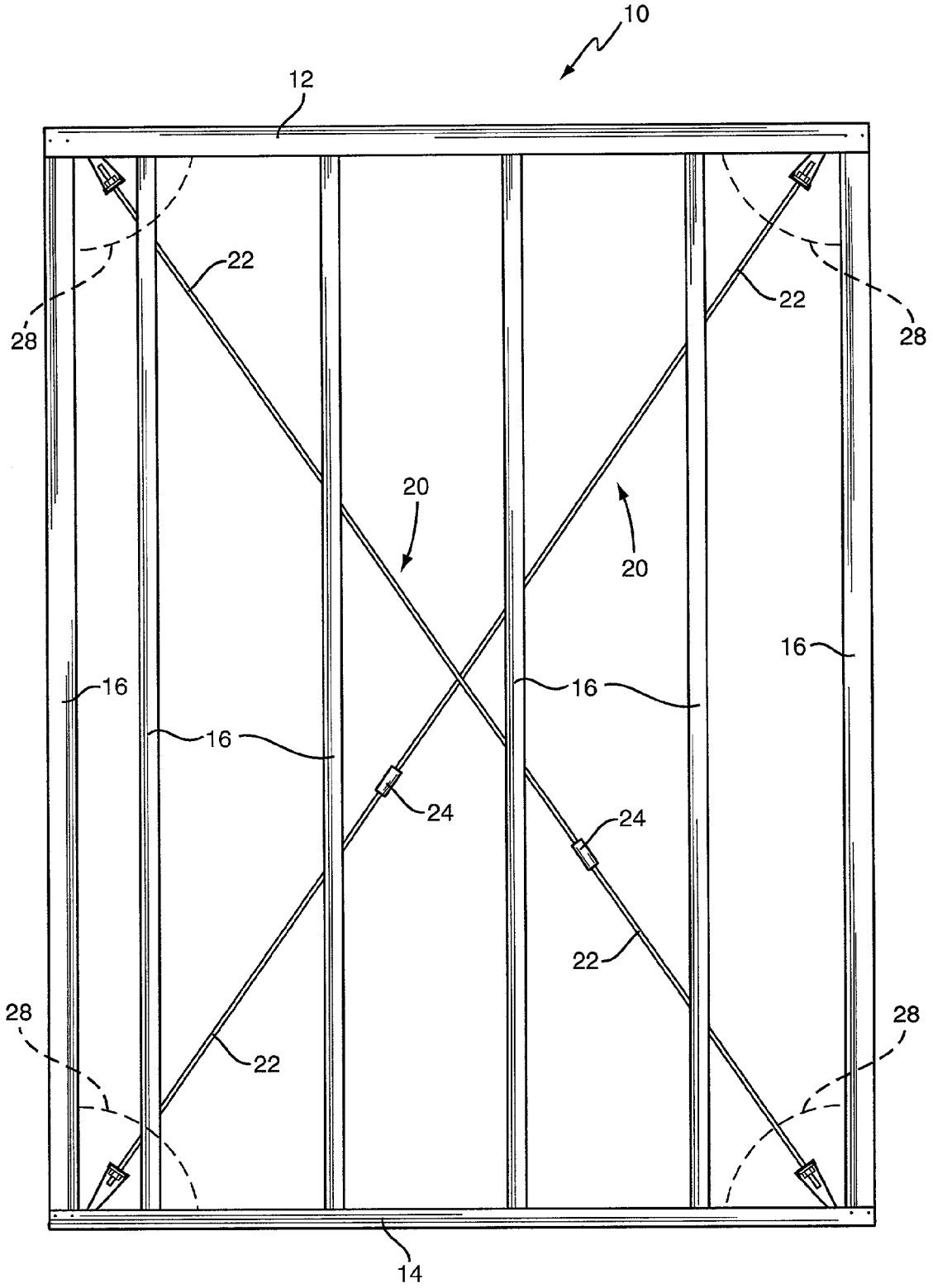
FIG. 2 is a side elevational view of the wall structure of the present invention.

As seen in FIG. 2, the wall structure includes four corner areas 28. The corner areas 28 are denoted by the area enclosed by the dotted lines referred to by the numeral 28. Extending between opposed corner areas are a pair of braces or support members 20. It should be appreciated that it is not required in some wall structures to have both braces or support members 20. In some designs and for some particular applications, a single brace 20 would be sufficient. In any event, as seen in the drawings, each of the braces 20 extend between opposed corner areas 28 of the wall structure.

Braces 20 extend through the openings 18 formed in the studs 16. Consequently, the braces 20 extend through a central plane or a central area of the wall structure 10. Expressed in another way, the wall structure 10 includes opposed sides. Disposed between the opposed sides of the wall structure is a central area that basically lies between the opposed sides. The braces or support members 20 extend diagonally through this central area.

The braces or support members 20 can assume various configurations or designs. For example, the braces 20 may be in the form of shafts, rods, cables or other types of connecting or support structures. In the embodiment illustrated in the drawings, each brace 20 is in the form of a rod or shaft and includes a pair of sections 22 joined together by a threaded coupling or threaded sleeve 24. Formed about each end of each brace 20 is a threaded end 26. However, it may be preferred to provide each diagonal brace as a single member with the opposite ends having left and right hand threads. This means that the single member brace can be secured and tightened into two opposite connectors by turning the single member brace in a single direction.

As discussed above, the wall structure 10 includes four corner areas 28. Each brace 20 extends between opposed corner areas and is effectively connected to opposed corner areas. More particularly, a connector, indicated generally by the numeral 30, is connected to each end portion of each brace 20 and is in turn connected to a corner area 28 of the wall structure. Generally, each connector 30 includes a pair of sections, a first section and a second section. The first section of the connector 30 extends from the end portion of a respective brace 20 towards a connecting point in the wall structure. The second section of the connector 30 actually connects to a portion of the wall structure 10. In terms of the embodiment illustrated in FIGS. 3 and 4, the first section of the connector comprises a generally triangular configuration. The second section of the connector 30 is that section that extends between a stud 16 or an end column and one of the members 12 and 14. As will be explained later, in the embodiment illustrated, the connector 30 comprises two plates that are mated together. In the first section, the plates are spaced apart, and as alluded to above, generally form the triangular configuration. The second section of the connector 30 is where the plates merge together and attach to the wall structure.

Figure 4:
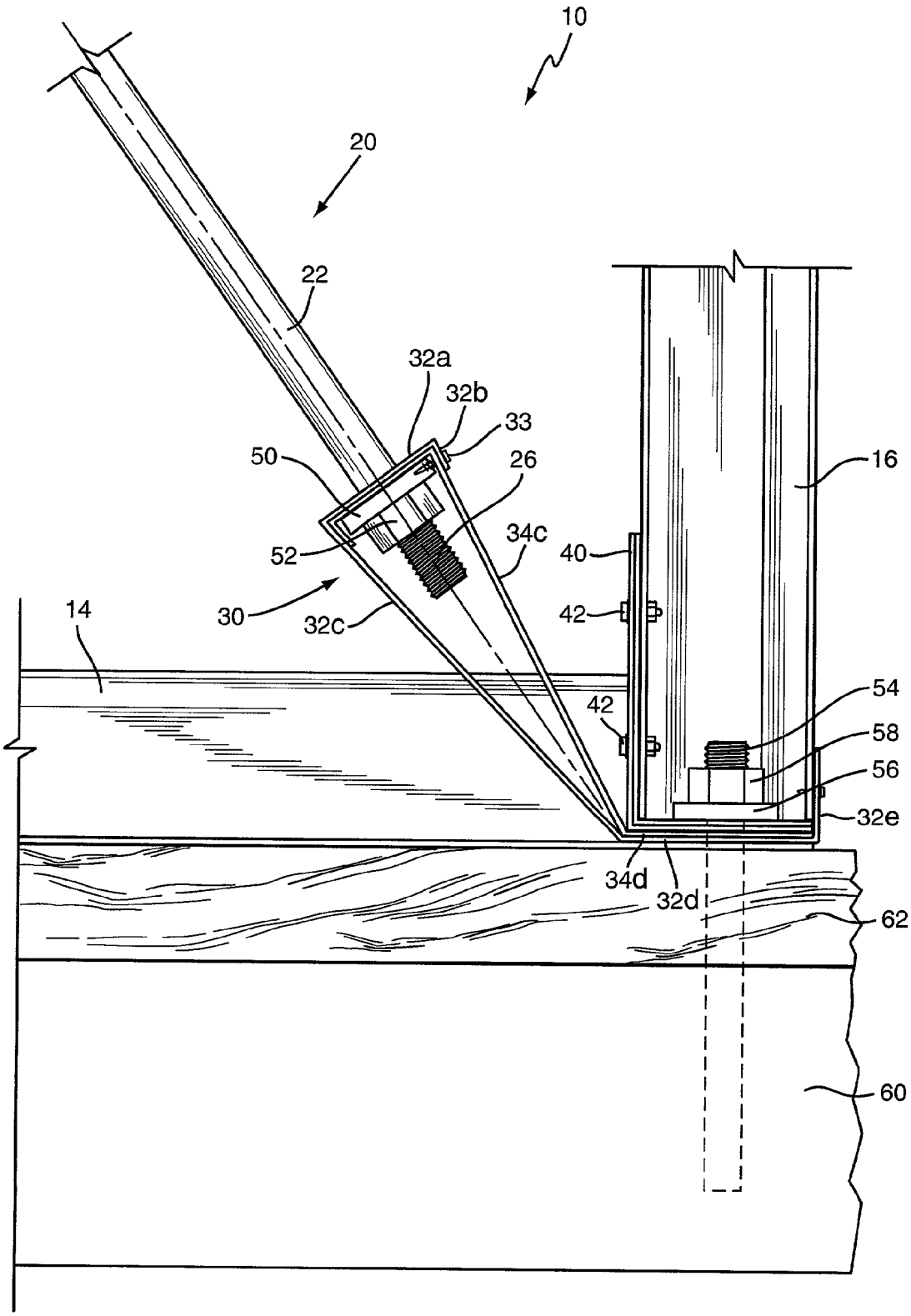
FIG. 4 is a view similar to FIG. 3, but with portions of the structure removed to better illustrate the invention.
Figure 5:
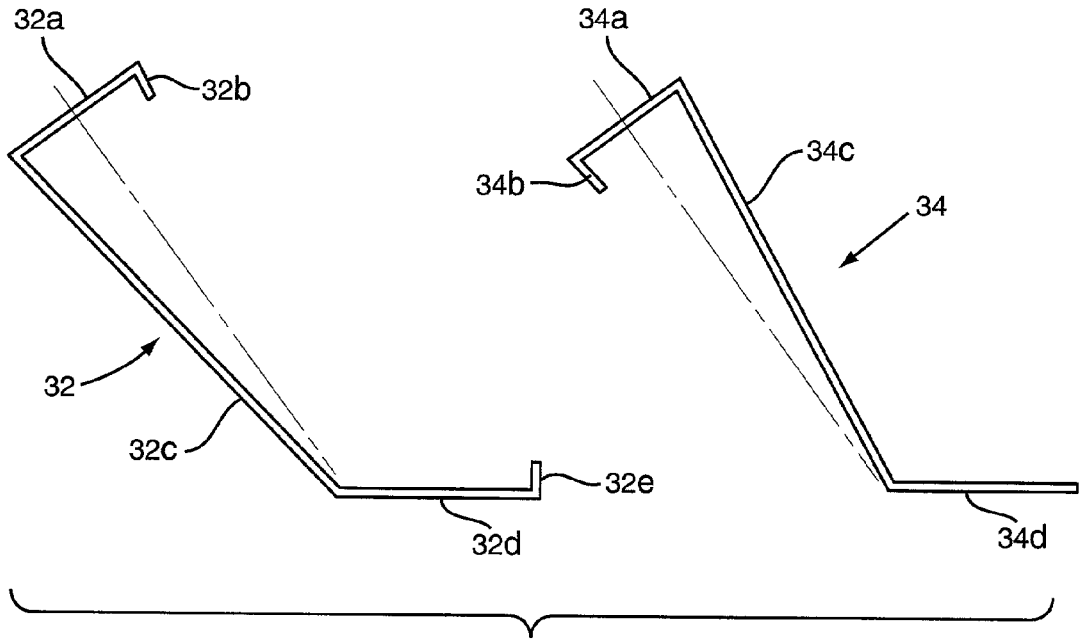
FIG. 5 is a side elevational view of the two plates that are utilized to form a connector in the wall structure.
Figure 6:
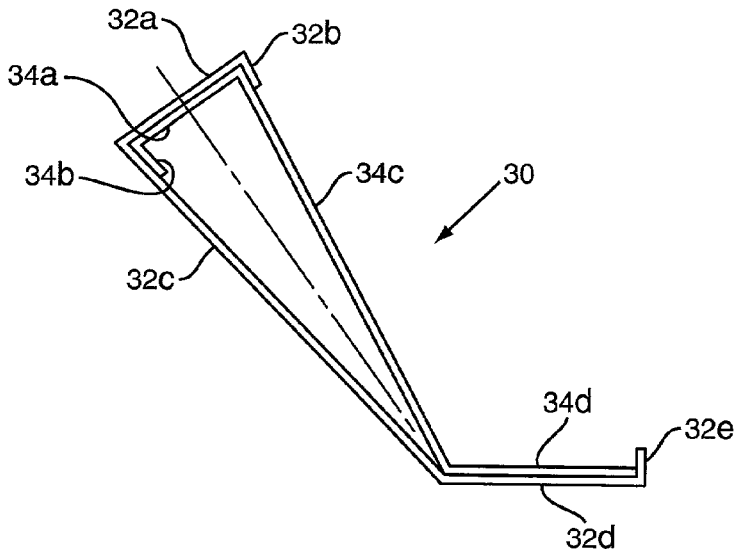
FIG. 6 is a side elevational view of the connector formed by the two plates shown in FIG. 5.

Thus, each connector 30 includes a pair of plates 32 and 34. FIG. 5 shows each of the plates. First, with respect to plate 32, the same includes a cross member 32*a* and a flange 32*b* formed across the cross member 32*a*. Extending from the cross member is a leg 32*c* that bends and forms a tail 32*d*. A flange 32*e* is turned up along the tail 32*d*. Similarly, the second plate, plate 34, includes a cross member 34*a* and a flange 34*b*. Extending from the cross member 34*a* is a leg 34*c* and a tail 34*d*. FIG. 6 shows plates 32 and 34 mated together. In particular, the second plate 34 is effectively inserted into plate 32 such that the legs 32*c* and 34*c* form the triangular configuration with the respective cross members 32*a* and 34*a*. Fasteners 33 extend through the plates 32 and 34 to secure them together. More particularly, as viewed in FIG. 4, the fasteners 33 extend through flange 32*b* and through the leg 34*c* to effectively secure the two plates 32 and 34 together about the section of the connector 30 that extends around the brace or rod 22. As viewed in FIG. 4, the lower ends of the legs 32*c* and 34*c* form an apex where the tail portions 32*d* and 34*d* merge. Flange 32*e* forms the terminal end of the connector 30 and basically turns up and extends past the terminal edge of tail 34*d*.

The cross members 32*a* and 34*b* include an opening that enables an end portion of a respective brace 20 to be extended therethrough. The second or tail section of the connector 30 is designed to be inserted between a stud or end column 16 and one of the members 12 and 14. This is particularly illustrated in FIG. 4. The upper section of the connector 30 as viewed in FIG. 4 is connected to an end portion of the brace or rod 20 by a retainer or nut 52. A spacer bar 50 is interposed between the retainer 52 and the cross member 34*a*. A mounting insert 40 is inserted between the tail section of the connector 30 and the stud or end column 16. In particular, the mounting insert 40 assumes a generally L-shape and is secured by fasteners 42 to a flange or other portion of the stud or end column 16. Also, the flange 32*e* of plate 32 turns up adjacent the lower portion of the stud 16 and is fastened thereto by a screw or other type of fastener. The connector 30 is firmly secured to the wall structure 10 by a bolt or anchor bolt 54 that extends through openings formed in the tail portions 32*d* and 34*d* as well as through openings formed in the mounting insert 40 and the lower member 14.

The connector 30 shown herein is fabricated from sheet metal. It will be understood and appreciated by those skilled in the art that the connector 30 could be a single casting or made from a number of castings.

Figure 3:
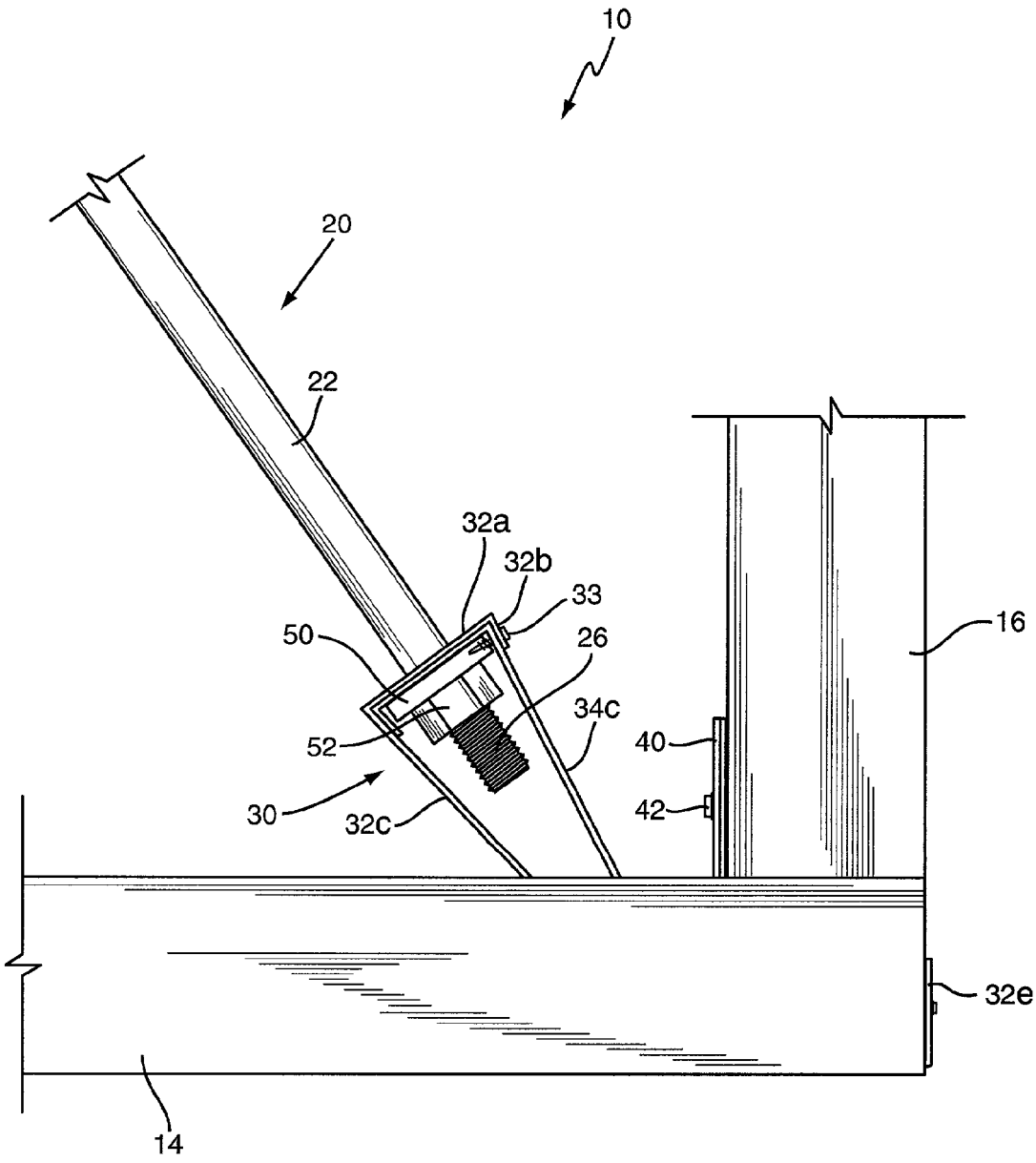
FIG. 3 is a fragmentary side elevational view of a corner portion of the wall structure.
Figure 3A:
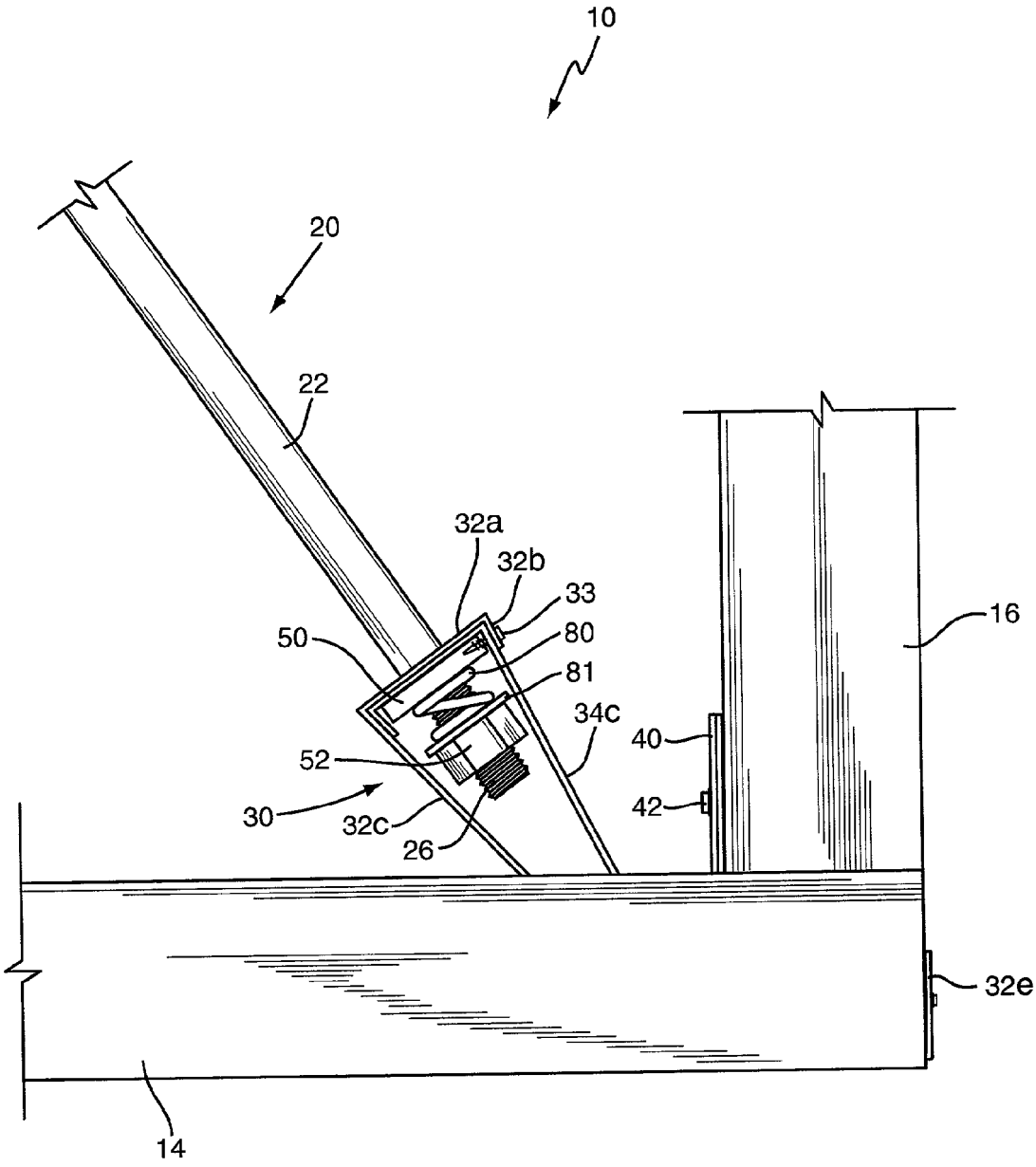
FIG. 3A is a view similar to FIG. 3, but which shows a modified connection between a corner connector and a brace.

FIG. 3A shows a modified form of connecting brace or member 20 to the opposed connectors 30. Here a spring 80 and a washer 81 are interdisposed between the spacer 50 and the nut 52. The strength, characteristics and size of spring 80 is selected so as to maintain the brace or member 20 in tension. For example, as the wall module 10 deforms or tends to deform one of the braces or member 20 may tend to be loosely connected between opposed connectors 30. As shown in FIG. 3A, the spring 80 will expand and effectively place the brace or member 20 in tension. When the wall module 10 assumes a no-load configuration or when the brace 20 is placed in tension, the spring 80 will assume a compressed configuration between the spacer 50 and the nut 52.

The wall structure 10 shown in FIGS. 1 and 2 can be supported in a number of ways. As illustrated in FIG. 4, the wall structure 10 is supported on a sill plate 62 and an underlying foundation 60. Thus, the anchor bolt 54 is extended downwardly through both the sill plate 62 and into the foundation 60. Although a sill plate is shown herein, it will be appreciated that in commercial application or applications that are not based on wood construction, that a sill plate would not be required.

The respective connectors 30 and the braces 20 attached thereto can be securely stationed or fastened within the wall structure by tightening the retainer 52. By tightening the retainer 52, each connector 30 is pulled or urged in an axial direction along the rod or shaft 22 that forms the brace 20. This effectively places the rod or brace 20 in tension.

It is appreciated that the connector 30 such as shown in FIGS. 3 and 4 would be disposed about the opposed corner areas 28 of the wall structure 10. Such a connector 30 would be anchored or secured within the wall structure in essentially the same manner as shown in FIG. 4. Connectors 30 disposed about the upper corner areas of the wall structure may be anchored or secured into various overlying structure. However, still the second or tail section of the connectors 30 would generally be anchored the same way. That is, they would extend between the upper member 12 and a stud or end column 16. In this case, the anchor bolt 54 might extend upwardly into a stiffener, a roof joist or even a concrete floor section. Those skilled in the art will appreciate that the corner areas of the wall structure 10 can be secured or anchored to many different types of overhead or underlying building constructions. In multi-story construction, the wall modules 10 can be vertically aligned. In particular, individual wall modules 10 can sandwich intervening floor sections with the upper member 12 of one wall module lying underneath and aligned with the lower member 14 of another wall module.

Figure 7:
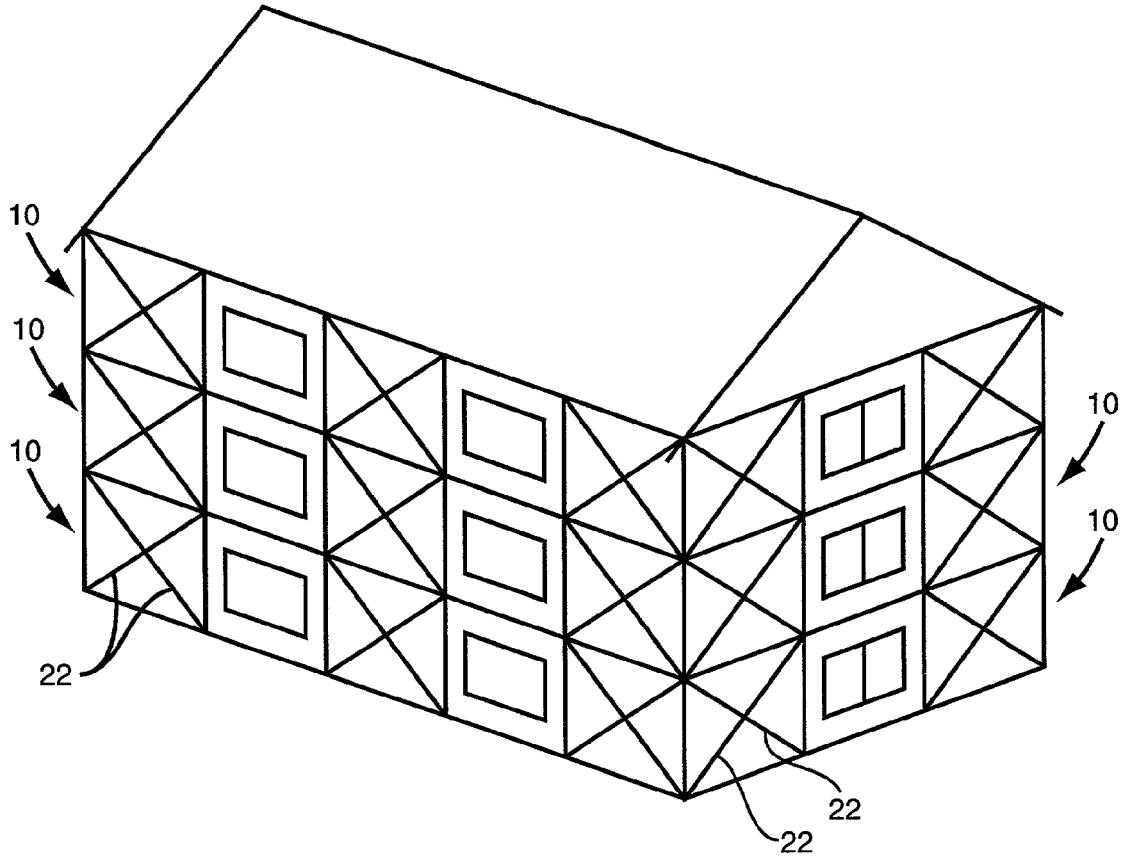
FIG. 7 is a perspective view illustrating how the wall structure or wall module of the present invention could be incorporated into a multistory structure.

The wall structure 10 of the present invention may be constructed of various components and materials. In one embodiment, it is contemplated that the wall structure would be of a basic metal construction. FIG. 7 is a schematic illustration of how the wall structure 10 could typically be utilized in a multistory structure. Note that the wall structures or modules are vertically aligned from the foundation to the roof. Further note that the wall structures or modules 10 are ideally equal in width and height and are located symmetrically throughout the exterior walls of the building. In some cases, exterior walls cannot provide sufficient rigidity and strength throughout a building. In these cases, it may be important to provide that rigidity and strength through interior walls. Consequently, the wall structure or module 10 of the present invention can be incorporated into interior walls. In particular, the wall structures or modules can be used within interior walls when the allowable span to width ratio for the roof diaphragm is exceeded.

From the foregoing specification and discussion, it is appreciated that the wall structure or modules 10 of the present invention can be constructed of various heights and widths. Once constructed in the fashion described, the wall structures or modules are inherently rigid and strong. Further, the wall structure or module 10 has the capacity to efficiently transfer shear loads to selected points in the wall structure such as to both upper and lower termination points. Thus, in the case of a shear load applied horizontally from the left, as viewed in FIG. 2, such shear loading will tend to result in the loads being transferred to the bottom corners of the wall structure 10. In this case, the lower right corner of the wall structure would be in compression while the lower left portion of the wall structure would be in tension. Also, because the braces or supports 20 are concentrically disposed within the wall structure itself, these shear forces or lateral loads are transferred in a concentric fashion throughout the wall structure. This avoids the drawbacks and problems that occur when the loads are transferred eccentrically.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A wall structure comprising: a pair of opposed members; a plurality of spaced apart studs connected between the opposed members; openings formed in respective studs; a pair of diagonal braces with each diagonal brace extending through openings within said studs; wherein the wall structure includes opposed corner areas and wherein at least one diagonal brace includes opposite end portions with each end portion being connected to a corner area through a connector; and each connector includes a plate structure that comprises two spaced apart members that eventually merge.

2. The wall structure of claim 1 wherein each diagonal brace extending through the openings within the studs is connected between the opposed corner areas.

3. The wall structure of claim 1 wherein at least one diagonal brace comprises an elongated rod.

4. The wall structure of claim 1 including four corner areas and a pair of diagonal rods with each rod extending through openings within respective studs and connected between two opposed corner areas.

5. The wall structure of claim 1 including a pair of sides and a central area disposed between the sides, and wherein each diagonal brace extends through the central area of the wall structure.

6. The wall structure of claim 5 wherein there is provided a pair of diagonal braces extending through the central area of the wall structure.

7. The wall structure of claim 1 wherein the diagonal brace is connected to the connector so as to maintain the diagonal brace in tension.

8. The wall structure of claim 7 including a spring operative to exert a tensioning force on the brace member.

9. The wall structure of claim 7 wherein the diagonal brace is connected to the connector so as to maintain the diagonal brace in tension substantially at all times.

10. The wall structure of claim 1 wherein each connector is anchored between a stud and one of the opposed members.

11. The wall structure of claim 1 wherein the spaced apart members extend from the brace and merge prior to being anchored between one stud and one of the opposed members.

12. A wall structure comprising:

an upper member;

a lower member;

a series of spaced apart studs connected between the upper and lower members;

openings provided in a plurality of the studs;

a pair of diagonal braces extending through the openings within the stud, and wherein the openings within the studs are spaced such that the diagonal braces extend between opposed corner areas of the wall structure;

a pair of connectors connected to opposite ends of each brace and extending therefrom to where the connectors connect to the opposed corner areas of the wall structure;

wherein each connector is secured between one stud and either the upper or lower member and each connector includes a pair of plates secured together to form a triangular configuration and wherein the triangular configuration projects from the brace towards the corner area where the connector is secured to the wall structure.

13. The wall structure of claim 12 wherein each brace comprises an elongated member.

14. The wall structure of claim 13 wherein the elongated member includes a rigid shaft.

15. The wall structure of claim 14 wherein the shaft includes opposed threaded ends and wherein each end of the shaft projects through an opening within one connector and wherein each connector is secured to the shaft by a retainer threaded onto the shaft and which is operative to secure the connector to the shaft.

16. The wall structure of claim 12 wherein the connector further includes a tail section where the plates come together and extend between one of the studs and either the upper member or lower member.

17. The wall structure of claim 12 wherein each connector extends from one end portion of each brace to a connection point in the wall structure, each connector including a first generally triangular shaped section and a second tail section where the tail section extends between one stud and the upper or lower member of the wall structure.

18. The wall structure of claim 12 wherein the wall structure includes a pair of opposed sides and a central area extending between the opposed sides, and wherein the brace extends through the central area of the wall structure.

19. A wall structure comprising: a pair of opposed members; a series of spaced apart studs connected between the opposed members; openings formed in a plurality of the studs; a pair of rigid members extending through the openings within the studs with the pair of rigid members extending generally diagonally through the wall structure such that each rigid member extends between opposed corner areas of the wall structure; a connector attached to opposite ends of each rigid member, each connector being secured to a corner area of the wall structure; and each connector includes a first section extending from the rigid member and a second section attached to the wall structure, the first section including a pair of spaced apart members and wherein the spaced apart members merge and come together to form at least a portion of the second section.

20. The wall structure of claim 19 wherein the second section of the connector extends between one stud and one of the opposed members of the wall structure.

21. The wall structure of claim 20 including a fastener that extends through the second section of the connector and effectively connects the connector to one of the studs and one of the opposed members of the wall structure.

22. A wall structure comprising:

an upper member;

a lower member;

a series of spaced apart studs connected between the upper and lower members;

openings provided in a plurality of the studs;

a diagonal brace extending between the openings within the studs, and wherein the openings within the studs are placed such that the diagonal brace extends between opposed corner areas of the wall structure;

a pair of connectors connected to opposite ends of each brace and extending therefrom to where the connectors connect to the opposed corner areas of the wall structure;

wherein each connector is secured between one stud and either the upper or lower member; and wherein each connector includes a pair of plates secured together to form a triangular configuration and wherein the triangular configuration projects from the brace towards the corner area where the connector is secured to the wall structure.

23. The wall structure of claim 22 wherein the connector further includes a tail section where the plates come together and extend between one of the studs and either the upper member or the lower member.

24. A wall structure comprising: a pair of opposed members; a series of spaced apart studs connected between the opposed members; openings formed in a plurality of the studs; at least one rigid member extending through the openings of the studs and extending between opposed corner areas of the wall structure; a connector attached to opposite ends of the rigid member, each connector being secured to a corner area of the wall structure; and wherein each connector includes a first section extending from the rigid member and a second section attached to the wall structure, the first section including a pair of spaced apart members and wherein the spaced apart members merge and come together to form at least a portion of the second section.

25. The wall structure of claim 24 wherein the second section of the connector extends between one studs and one of the opposed members of the wall structure.

26. The wall structure of claim 25 including a fastener that extends through the second section of the connector and effectively connects the connector to one of the studs and one of the opposed members of the wall structure.

* * * * *